US007395942B2

(12) United States Patent
Michalopoulos

(10) Patent No.: US 7,395,942 B2
(45) **Date of Patent: *Jul. 8, 2008**

(54) WINE BOTTLE CLOSURE APPARATUS

(76) Inventor: James Michalopoulos, 2112 Charlres St., New Orleans, LA (US) 70116-2028

( * ) Notice: Subject to any disclaimer, the term of this patent is extended or adjusted under 35 U.S.C. 154(b) by 326 days.

This patent is subject to a terminal disclaimer.

(21) Appl. No.: 10/842,375

(22) Filed: May 10, 2004

(65) Prior Publication Data

US 2005/0247660 A1 Nov. 10, 2005

(51) Int. Cl.
*B65D 51/16* (2006.01)
*B65B 31/06* (2006.01)
*B65B 3/16* (2006.01)

(52) U.S. Cl. ..... 215/311; 215/260; 215/262; 215/228; 141/65; 141/114

(58) Field of Classification Search ..... 215/260, 215/262, 311; 220/231, 367.1; 141/65, 64, 141/66, 114; 417/480
See application file for complete search history.

(56) References Cited

U.S. PATENT DOCUMENTS 1,788,795 A 1/1931 Hoban
3,109,563 A * 11/1963 Morales ..... 222/192
3,129,835 A 4/1964 Collens
3,557,986 A 1/1971 Poole, Jr.
3,602,387 A 8/1971 Patnaude
3,672,114 A * 6/1972 Sacks ..... 53/88
4,482,072 A 11/1984 Hankins
4,684,033 A 8/1987 Marcus
4,763,803 A 8/1988 Schneider
4,889,250 A 12/1989 Beyer
4,998,633 A * 3/1991 Schneider ..... 215/311
5,031,785 A 7/1991 Lemme
5,535,900 A * 7/1996 Huang ..... 215/228
5,957,317 A 9/1999 Lee
6,637,321 B2 * 10/2003 Wang ..... 99/472
7,051,901 B2 * 5/2006 Hickert ..... 222/1

* cited by examiner

*Primary Examiner*—Anthony Stashick
*Assistant Examiner*—James N Smalley
(74) *Attorney, Agent, or Firm*—Garvey, Smith, Nehrbass & North, L.L.C.; Charles C. Garvey, Jr.

(57) ABSTRACT

An improved wine bottle closure and vacuum pump apparatus is disclosed. The apparatus provides an improved bulb structure to be used for pumping and storage purposes, the bulb remaining with a closure plug even after pumping is completed and the wine is to be stored for later consumption. The bulb structure can be collapsed in two different positions including a first position that maintains overall height of the bulb structure and a second position that enables the bulb structure to be shortened in height as an optional feature. The bulb structure provides an enlarged central section that is much larger in diameter than the lower end portion. The lower end portion provides a closure plug for fitting the opening of a wine bottle.

21 Claims, 3 Drawing Sheets

WINE BOTTLE CLOSURE APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to wine bottle closure devices and more particularly wine bottle closure devices that employ a vacuum to remove air from the interior of the wine bottle, preserving the integrity of the wine. Even more particularly, the present invention relates to a wine bottle closure apparatus of improved configuration that employs a hollow bulb structure having an enlarged diameter center section, opposed upper and lower smaller diameter sections, each of the smaller sections carrying a check valve, the lower end portion having a bottle closure plug sized and shaped to form a seal with the bottle opening of a wine bottle, and wherein the bulb structure is optionally collapsible into two different collapsed positions including a first collapsed position that maintains the overall height of the bulb structure and a second position that shortens the height of the bulb so that the combination of wine bottle and bulb are more easily stored in between the shelves of a refrigerator.

2. General Background of the Invention

Many devices have been patented that relate generally to the concept of pumping air from the inside of a wine bottle after it has been partially consumed. These patents discuss the use of pumps to remove air from the interior of the wine bottle and thus maintain a freshness and integrity of the wine. Examples of these patents can be seen in the following table:

TABLE 1

| U.S. Pat. No. | TITLE | ISSUE DATE |
|---|---|---|
| 1,788,795 | Valve Controlled For Bottles Containing Carbonated Beverages | Jan. 13, 1931 |
| 3,129,835 | Food Preservation | Apr. 21, 1964 |
| 3,557,986 | Pressurizing Closure Device | Jan. 26, 1971 |
| 3,602,387 | Pump and closure Assembly | Aug. 31, 1971 |
| 4,482,072 | Pressurizing Apparatus For Partially Filled Containers | Nov. 13, 1984 |
| 4,684,033 | Device For Retarding Oxidation of Partly Consumed Bottle of Wine | Aug. 04, 1987 |
| 4,763,803 | Stopper For a Container Such as a Bottle, and a Pump Connectable Thereto For Extraction of Gaseous Medium From or Pumping in Thereof into the Container | Aug. 16, 1988 |
| 4,889,250 | Vacuum Pump and Enclosure Assembly For Beverage Container | Dec. 26, 1989 |
| 5,031,785 | Combination Vacuum/Pressure Pump and Valve Stopper for Food or Drink Containers | Jul. 16, 1991 |
| 5,957,317 | Evacuation Actuating Closure for a Container | Sep. 28, 1999 |

The Hoban patent U.S. Pat. No. 1,788,795 entitled "Valve Control Closure for Bottles Containing Carbonated Beverage" is designed to maintain the carbonation of a drink product contained in a bottle by preventing it from becoming "flat".

In the Collens patent U.S. Pat. No. 3,129,835, there is said to be value in protecting foods from bacterial deterioration using vacuum. The device disclosed in the '835 patent is said to have particular utility in the protection of coffee and numerous other items of food under vacuum. The Collens device discloses a wide mouth jar having a closure cap that employs valves. A hemispherically shaped flexible member or domed shaped member of rubber is used to squeeze air from the container.

The Poole patent U.S. Pat. No. 3,557,986 discloses a pressurizing closing device.

The Patnaude patent U.S. Pat. No. 3,602,387 discloses a pump and closure assembly that employs a bellows 20 said to be molded from a flexible plastic material. The bellows connects to a closure assembly that includes a single one way valve. An exhaust valve is provided at the top of the bellows. When the bellows is compressed, air is evacuated from the bellows. A coil spring is contained inside the bellows. The spring urges the bellows to an extended position so that as it expands. The device pumps air from the interior of a bottle to which it is attached.

The Hankins patent U.S. Pat. No. 4,482,072 discloses a pressurizing apparatus for partially filled containers.

The Marcus patent U.S. Pat. No. 4,684,033 discloses a device for retarding oxidation of a partially consumed bottle of wine. It employs a bulb and flexible flow line to pump air from the inside of the bottle.

The Schneider patent U.S. Pat. No. 4,763,803 discloses a stopper for a container (such as a bottle) and a pump connectable thereto for extraction of gaseous medium from or pumping into thereof into the container. The stopper and pump are separate structures that are connected together only when pumping is to occur. The stopper remains in the bottle as a closure device.

The Beyer patent U.S. Pat. No. 4,889,250 discloses a vacuum pump and enclosure assembly for a beverage container.

A combination vacuum/pressure pump and valve stopper for food or drink containers is disclosed in the Lemme patent U.S. Pat. No. 5,031,785.

The Lee patent U.S. Pat. No. 5,957,317 discloses an evacuation actuating closure for a container.

Some of these patents are designed to work only with wide mouth containers. Others of these devices employ complicated pumping devices that would be expensive to manufacture and prone to damage or leakage. For example, the Patnaude patent U.S. Pat. No. 3,602,387 employs a bellows with an internal spring. The spring would be an expensive part to install inside of a bellows. Further, the bellows provides a number of sharp corners and seams that would be prone to fatigue, cracking and eventually leakage.

The Hankins patent U.S. Pat. No. 4,482,072 discloses a complicated pump arrangement that would be expensive to manufacture. It would occupy a huge amount of space if remained in position upon the bottle after installation. Likewise, the Marcus, '033 patent discloses a complicated pumping arrangement that would occupy an excessive amount of space if it were left attached to the bottle.

The Schneider patent U.S. Pat. No. 4,763,803 requires a separate pump and separate stopper arrangement that would require one or the other to be located every time the device is to be used. A similar device that employs separate pump and stopper is sold under the mark "Vacuvin".

It is known that oxygen has a deleting effect on the quality of wine over a period of time. The chemistry of wine is very complex and the constituents can be in the hundreds. Many appear as trace elements and can be directly oxidized from prolonged exposure to oxygen.

Oxygen can also affect the visual appearance of wine, creating a clouding of the wine from oxidized coloring matter within the wine. In addition to the negative deteriorative effects of oxygen on both the flavor and the coloring of the wine, oxygen changes some flavor components into acetic acid.

BRIEF SUMMARY OF THE INVENTION

The present invention solves prior art problems and shortcomings by providing a simple and convenient air/oxygen removal system for bottled wines that employs a squeeze type hand pump that fits the open mouth of a wine bottle and remains with the wine bottle once air and oxygen have been evacuated.

The improved pump arrangement of the present invention expels any air from within the wine bottle that could contribute to the source of flavor or essence deterioration of wine that remains within the bottle after it has been opened. The present invention provides an improved wine bottle closure apparatus that evacuates air from a wine bottle that has a neck with a bottle opening that communicates with a bottle interior.

The present invention employs an improved wine bottle closure device with a specially configured hollow bulb structure that has a bulb interior, an enlarged diameter center section, opposed upper and lower smaller diameter sections, and tapered transitions sections that extend from each of the upper and lower smaller diameter sections to the lower diameter section.

The bulb structure has an inflated position with a height. During use, the bulb can optionally be collapsed to one of two different collapsed positions. These positions can include at least one collapsed position that shortens the height of the bulb structure, thus providing a better storage configuration for the combination of wine bottle closure device and wine bottle after air has been pumped from the bottle using the bulb structure. With the present invention, it is not necessary to separate the vacuum pump and plug or stopper. The apparatus can be collapsed and shortened so that very little space is occupied by it (see FIGS. 5 and 7). It can then remain with the wine bottle until the contents are consumed at a later date.

The bulb structure includes a closure plug or stopper at its lower end portion that is sized and shaped to form a seal with a wine bottle opening. A bottle closure plug attaches to the lower section of the bulb and it has an open ended air flow channel that communicates with the bulb interior so that air can travel from the interior of the wine bottle to the interior of the bulb during pumping. The channel provides upper and lower openings at respective end portions of the channel.

A first check valve is mounted to an assembly of the bulb structure enclosure plug at a position that is next to the bulb structure lower section. The first check valve enables air flow in an upward direction from the plug air passage to the plug interior and disallowing substantial air flow in a downward direction from the bulb interior to the plug lower opening.

The second check valve is mounted to the bulb structure at a position next to the upper smaller diameter section. Either of the check valves can be of a type that can be opened to vent the bulb interior when not pumping. Alternatively, a relief valve can be optionally mounted on the bulb wall 17 for releasing any vacuum.

A bulb flow outlet is carried by the upper smaller diameter section and enables air to flow from the bulb interior through the second check valve to the atmosphere.

The bulb structure is preferably a resilient structure having a memory that urges the bulb wall to return to an expanded position. When the bulb is squeezed, air is thus evacuated from the bulb interior via the bulb flow outlet. The bulb has a collapsed position that subjects the bulb interior to a vacuum or sub-atmospheric pressure as the wall attempts to return to the expanded position.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
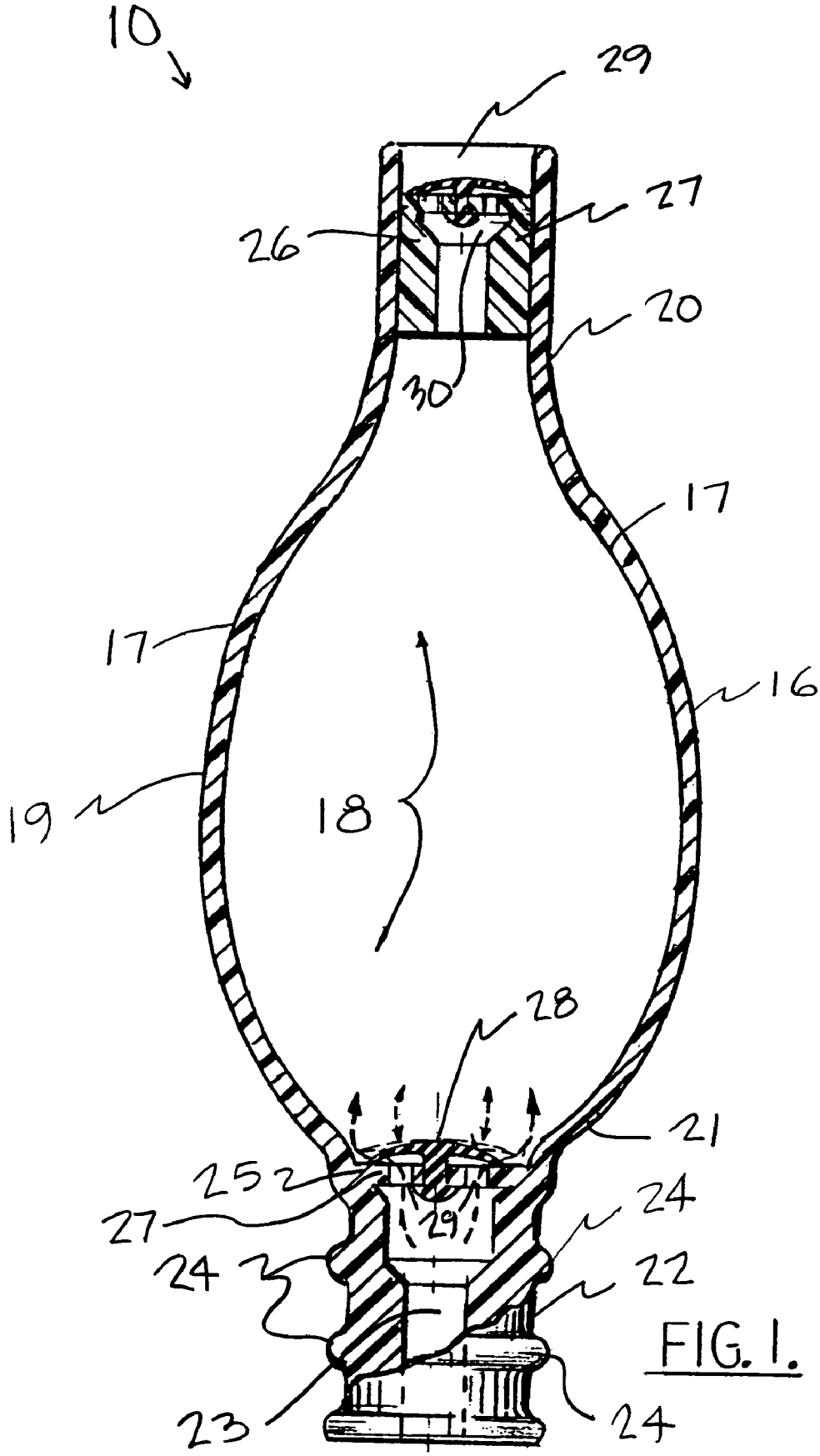
FIG. 1 is a sectional elevational view of the preferred embodiment of the apparatus of the present invention.

Wine bottle closure apparatus 10 is shown in FIG. 1 in detail and in FIGS. 2-6 when attached to a conventional wine bottle 11 having a lower section 12 that contains liquid contents, i.e. wine 34. Bottle 11 provides an interior 45 that normally contains air above liquid when the liquid 34 has been partially consumed. Bottle 11 provides a neck 13 and can have an enlarged diameter section 14 providing an opening 15 through which the contents can be dispensed.

Wine bottle closure apparatus 10 includes a bulb structure 16 having wall 17 and an interior 18. The bulb structure 16 has a larger diameter center section 19, a smaller diameter upper section 20 and a smaller diameter lower section 21.

Lower end portion 21 connects with apertured closure plug 22 as shown in FIGS. 1, 3, 4 and 5. Plug 22 has air flow passageway 23 that enables air to be pumped from interior 45 of bottle 11 to interior 18 of bulb structure 16.

Plug 22 can be provided with one or more annular sealing rings 24 that help form a seal between plug 22 and bottle 11 at enlarge diameter section 14 of neck 13. Plug 22 and bulb 16 can be an integral structure of rubber or polymeric material (e.g. polyurethane).

Figure 3:
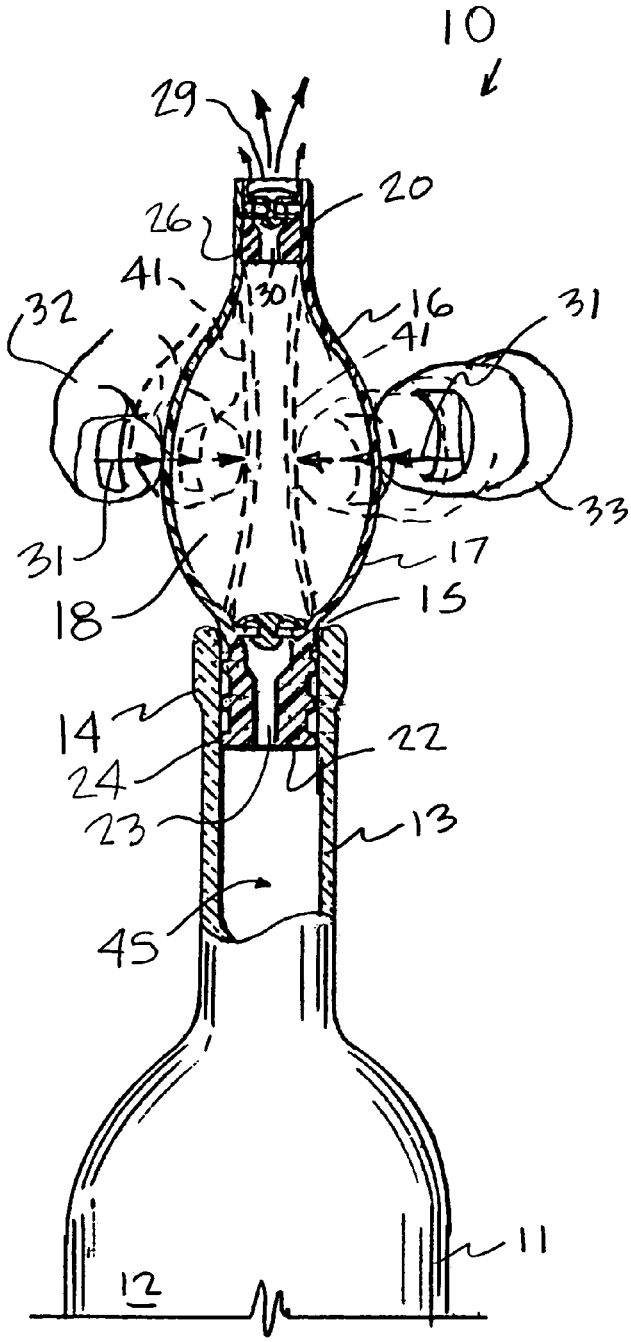
FIG. 3 is a partial sectional elevational view of the preferred embodiment of the apparatus of the present invention showing the bulb in an inflated, expanded position and in a collapsed position (phantom lines) both of which maintain a maximum overall height for the bulb structure.
Figure 4:
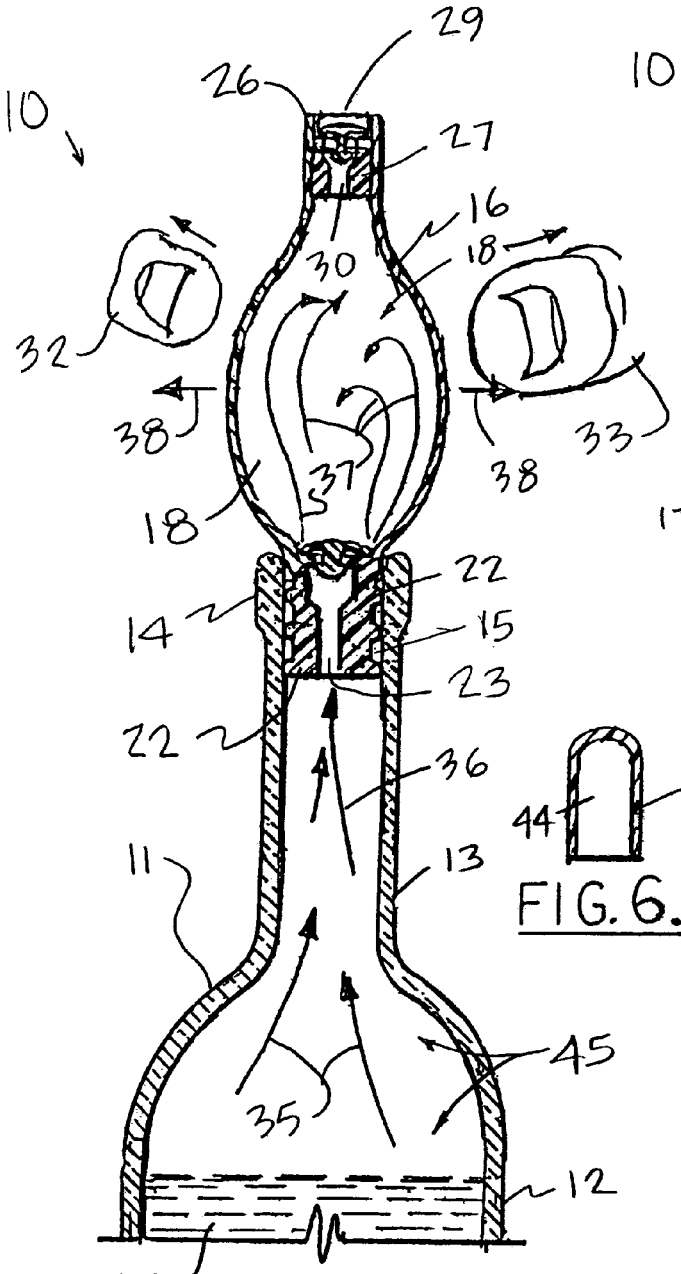
FIG. 4 is a sectional elevational view of an alternative embodiment of the apparatus of the present invention illustrating pumping to remove air from a wine bottle.

A pair of check valves 25, 26 are provided with bulb structure 16 including a lower check valve 25 and an upper check valve 26. In FIGS. 1, 3 and 4, lower check valve 25 provides a perforated check valve body 27 that can be an integral part of bulb structure 16. Valving member 28 can be a disk member that forms a closure over air flow perforations or outlets 29 in valve body 27. Similarly, upper check valve 26 provides a perforated valve body 27 having flow passage 30 that communicates with air flow outlet 29 at the uppermost end portion of bulb structure 16. Each check valve 25, 26 can be a valve that can be opened to allow air to vent bulb interior 18, such as when the device 10 is separated from bottle 11 after use.

In order to pump air from bottle interior 45, a user employs finger 32 and thumb 33 to collapse bulb structure 16 by pressing the finger 32 and thumb 33 together in the direction of arrows 31 in FIG. 3. When the bulb structure 16 is collapsed to the position shown in FIG. 3 in phantom lines, a vacuum is formed in bulb interior 18 because the wall 17 has a memory and is biased to return to its original position of FIGS. 1, 2 and 4 (in hard lines in FIG. 3). The bulb wall 17 can be of rubber, polyurethane or other suitable polymeric material. Such bulb wall material is commonly employed, for example, in the bulb type pumps associated with common, commercially available blood pressure measuring devices.

Figure 2:
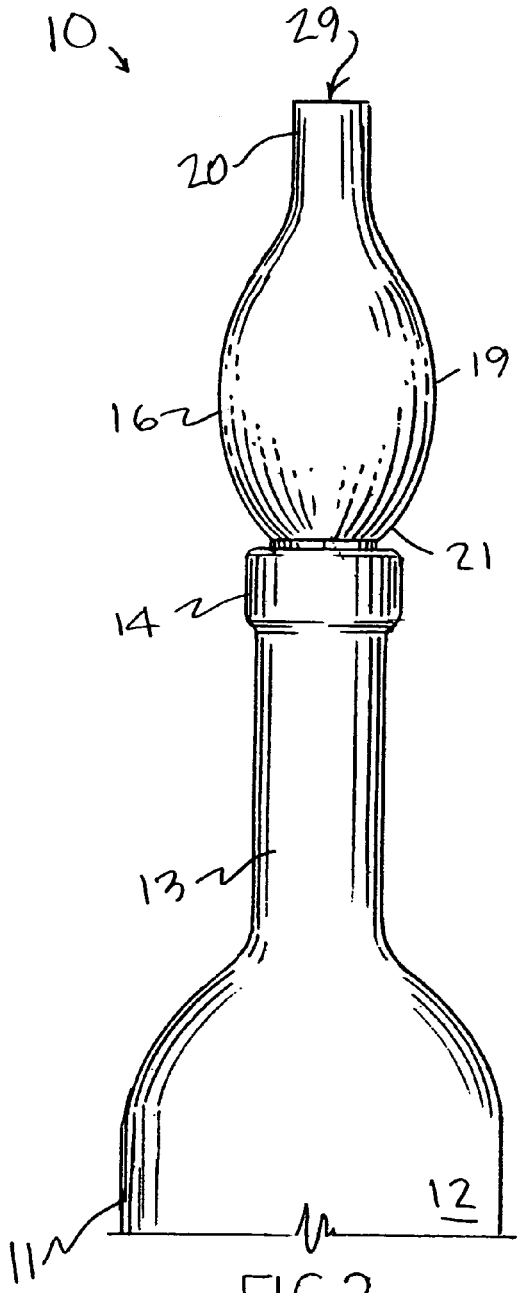
FIG. 2 is an elevation view of the preferred embodiment of the apparatus of the present invention shown attached to a common wine bottle.

As the bulb wall 17 attempts to return to its original position of FIGS. 1, 2 and 3, as illustrated by arrows 38 in FIG. 4, air travels in the direction of arrows 35, 36 through passage 23 of plug 22 and into bulb interior 18. Air entering into bulb 18 is schematically illustrated by arrows 37.

Figure 5:
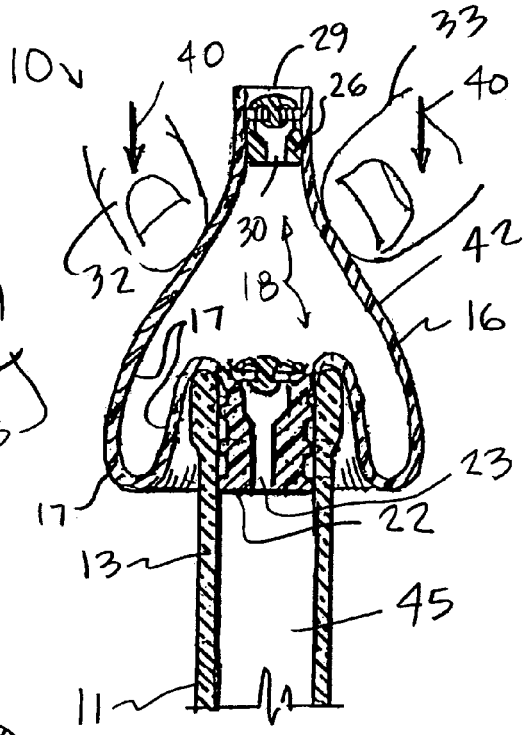
FIG. 5 is a sectional view of the preferred embodiment of the apparatus of the present invention showing the bulb structure in a collapsed position that shortens the bulb structure.
Figure 7:
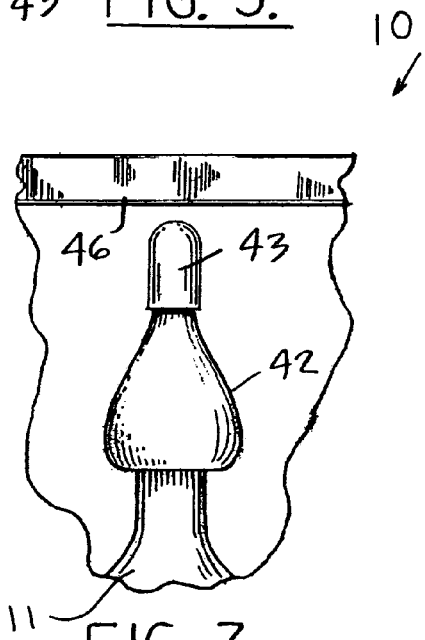
FIG. 7 is a perspective side view of the preferred embodiment of the apparatus of the present invention showing the bulb structure in a collapsed position that shortens the bulb structure.

While the collapsed wall position during pumping is shown by the numeral 41 in FIG. 3, a second collapsed position of bulb structure 16 is shown in FIGS. 5 and 7 and indicated by the numeral 42. The collapsed storage position 42 shortens the overall height of bulb structure 16 as schematically illustrated by arrows 40 in FIG. 5 when compared to FIGS. 1, 2 and 4.

Figure 6:
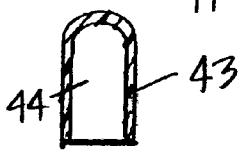
FIG. 6 is a fragmentary sectional view of the preferred embodiment of the apparatus of the present invention illustrating the closure cap that fits the upper end portion of the bulb structure.

A cap 43 having a cap interior 44 can be placed over smaller diameter upper end portion 20 as shown in FIG. 6 to prevent any leakage over a period of time such as when the wine bottle closure apparatus 10 and bottle 11 are stored in a refrigerator below shelf 46 as seen in FIG. 7. The shortened collapsed storage position 42 enables the combination of bottle 11 and wine bottle closure apparatus 10 to be stored in between two more closely spaced apart refrigerator shelves 46.

The following is a list of parts and materials suitable for use in the present invention:

PARTS LIST

| Part Number | Description |
|---|---|
| 10 | wine bottle closure apparatus |
| 11 | bottle |
| 12 | lower section |
| 13 | neck |
| 14 | enlarged diameter section |
| 15 | opening |
| 16 | bulb structure |
| 17 | wall |
| 18 | interior |
| 19 | larger diameter center section |

-continued

| Part Number | Description |
|---|---|
| 20 | smaller diameter upper section |
| 21 | smaller diameter lower section |
| 22 | apertured closure plug |
| 23 | air flow passageway |
| 24 | annular ring |
| 25 | lower check valve |
| 26 | upper check valve |
| 27 | check valve body |
| 28 | valving member |
| 29 | air flow outlet |
| 30 | flow passage |
| 31 | arrow |
| 32 | user's finger |
| 33 | user's thumb |
| 34 | liquid |
| 35 | arrow |
| 36 | arrow |
| 37 | arrow |
| 38 | arrow |
| 40 | arrow |
| 41 | collapsed wall pumping position |
| 42 | storage position |
| 43 | cap |
| 44 | cap interior |
| 45 | bottle interior |
| 46 | shelf |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A wine bottle closure apparatus that evacuates air from a wine bottle having a neck and bottle top with a bottle opening that communicates with a bottle interior, comprising:

a) a hollow bulb structure that has a bulb interior, an enlarged diameter center section, opposed upper and lower smaller diameter sections, and tapered sections that extend from each of the upper and lower smaller diameter sections to the larger diameter section, the bulb structure having an inflated position with an overall maximum bulb height and two different collapsed bulb positions including a first collapsed bulb position that does not substantially alter the bulb height and a second collapsed bulb position that shortens the bulb height to a minimum bulb height, and wherein in the second collapsed position a part of the bulb enlarged diameter center section is folded downwardly and wherein there is no fold in between the center section and the upper smaller diameter section;

b) a bottle closure plug that is sized and shaped to form a seal with the plug attaching to the lower section of the bulb, the closure plug having a bottom surface, an open ended air flow channel that communicates with the bulb interior, an upper opening and a lower opening at respective end portions of the channel;

c) a first check valve mounted to an assembly of bulb structure and closure plug at a position that is next to the bulb structure lower section, the first check valve enabling air flow in an upward direction from the plug air passage to the bulb interior and disallowing substantial air flow in a downward direction from the bulb interior to the plug lower opening;

d) a second check valve mounted to the bulb structure at a position next to the upper smaller diameter section;

e) a bulb flow outlet carried by upper smaller diameter section;

f) wherein the second check valve enables flow between the bulb interior and the bulb flow outlet;

g) the bulb structure being a resilient structure having a memory so that when the bulb is squeezed, air is evacuated from the bulb interior via the bulb flow outlet and the bulb assumes the first collapsed positions that maintains maximum bulb height, subjecting the bulb interior to subatmospheric pressure; and h) wherein in the second collapsed bulb position, part of the larger diameter section of the bulb extends below the bottle top and to the level of the bottom surface of the closure plug.

2. The wine bottle closure apparatus of claim 1 wherein the upper and lower smaller diameter sections are about the same diameter.

3. The wine bottle closure apparatus of claim 1 wherein the bulb structure has a bulb height and can be collapsed to a position that shortens the bulb height.

4. The wine bottle closure apparatus of claim 1 wherein the plug is generally cylindrically shaped having a central longitudinal axis, said air flow channel being generally aligned with said longitudinal axis.

5. The wine bottle closure apparatus of claim 1 wherein the first check valve is contained in the closure plug.

6. The wine bottle closure apparatus of claim 4 wherein the first check valve is contained in the closure plug.

7. The wine bottle closure apparatus of claim 1 wherein the bulb structure includes a flexible side wall.

8. The wine bottle closure apparatus of claim 7 wherein in the second collapsed position, the flexible side wall folds to provide a circumferentially extending fold that surrounds the closure plug and shortens bulb height.

9. The wine bottle closure apparatus of claim 1 further comprising a wine bottle having a body, a tapered neck and a bottle opening at the top of the neck, wherein the closure plug occupies the bottle opening during use.

10. The wine bottle closure apparatus of claim 9 wherein the check valve occupies a position in the bottle opening.

11. A wine bottle closure apparatus that evacuates air from a wine bottle having a neck and bottle top with a bottle opening that communicates with a bottle interior, comprising:

a) a hollow bulb structure that has a bulb interior, an enlarged diameter center section, opposed upper and lower smaller diameter sections, and tapered sections that extend from each of the upper and lower smaller diameter sections to the larger diameter section, the bulb structure having an inflated position with an overall maximum bulb height and two different collapsed bulb positions including a first collapsed bulb position that maintains the maximum bulb height and a second a collapsed bulb position that shortens the bulb height to a minimum bulb height, and wherein in the second collapsed bulb position a part of the bulb enlarged diameter center section is folded to form only a single fold, the single fold being lowered;

b) a bottle closure plug that is sized and shaped to form a seal with the plug attaching to the lower section of the bulb, the closure plug having a bottom surface, an open ended air flow channel that communicates with the bulb interior, an upper opening and a lower opening at respective end portions of the channel;

c) a first check valve mounted to an assembly of bulb structure and closure plug at a position that is next to the bulb structure lower section, the first check valve enabling air flow in an upward direction from the plug air passage to the bulb interior and disallowing substantial air flow in a downward direction from the bulb interior to the plug lower opening;

d) a second check valve mounted to the bulb structure at a position next to the upper smaller diameter section;

e) a bulb flow outlet carried by upper smaller diameter section;

f) wherein the second check valve enables flow between the bulb interior and the bulb flow outlet;

g) the bulb structure being a resilient structure having a memory so that when the bulb is squeezed, air is evacuated from the bulb interior via the bulb flow outlet collapsing the bulb to the first collapsed position that subjects the bulb interior to a vacuum and wherein the collapsed position can be selected to either shorten the bulb's height or maintain the bulb's maximum bulb height; and h) wherein in the second collapsed position, formed fold of the enlarged diameter center section is lowered to the level of the plug bottom surface.

12. The wine bottle closure apparatus of claim 11 wherein the upper and lower smaller diameter sections are about the same diameter.

13. The wine bottle closure apparatus of claim 11 wherein in the second collapsed position the bulb structure center section folds downwardly at a fold to shorten bulb height and wherein the center section surrounds the bottle top at the fold.

14. The wine bottle closure apparatus of claim 11 wherein the plug is generally cylindrically shaped having a central longitudinal axis, said air flow channel being generally aligned with said longitudinal axis.

15. The wine bottle closure apparatus of claim 11 wherein the first check valve is contained in the closure plug.

16. The wine bottle closure apparatus of claim 14 wherein the first check valve is contained in the closure plug.

17. The wine bottle closure apparatus of claim 11 wherein the bulb structure includes a flexible side wall.

18. The wine bottle closure apparatus of claim 17 wherein in the second collapsed position, the flexible side wall can be folded to provide an annular fold that surrounds the closure plug and shortens bulb height.

19. The wine bottle closure apparatus of claim 11 further comprising a wine bottle having a body, a tapered neck and a bottle opening at the top of the neck, wherein the closure plug occupies the bottle opening during use.

20. The wine bottle closure apparatus of claim 19 wherein the check valve occupies a position in the bottle opening.

21. A wine bottle closure apparatus that evacuates air from a wine bottle having a neck and bottle top with a bottle opening that communicates with a bottle interior, comprising:

a) a hollow bulb structure that has a bulb interior, an enlarged diameter center section, opposed upper and lower smaller diameter sections, and tapered sections that extend from each of the upper and lower smaller diameter sections to the larger diameter section, the bulb structure having an inflated position with an overall maximum bulb height and multiple collapsed bulb positions;

b) the bulb structure lower section including a bottle closure plug that is sized and shaped to form a seal with the bottle opening, said closure plug having a bottom surface, an air flow channel for communicating between the bulb interior and the wine bottle interior, the channel providing apposed openings;

c) a first check valve mounted to an assembly of bulb structure and closure plug at a position that is next to the bulb structure lower section, the first check valve enabling air flow in an upward direction from the plug air passage to the bulb interior and disallowing substantial air flow in a downward direction from the bulb interior to the plug lower opening;

d) a second check valve mounted to the bulb structure at a position next to the upper smaller diameter section;

e) a bulb flow outlet carried by upper smaller diameter section;

f) wherein the second check valve enables flow between the bulb interior and the bulb flow outlet;

g) the bulb structure being a resilient structure having a memory so that when the bulb is squeezed, air is evacuated from the bulb interior via the bulb flow outlet and the bulb has a collapsed position that subjects the bulb interior to subatmospheric pressure; and h) wherein the collapsed position can be selected from a first collapsed bulb position that maintains the maximum bulb height and a second collapsed bulb position that reduces bulb height and wherein the enlarged diameter center section folds to produce a folded portion about halfway between the opposed upper and lower smaller diameter sections that is lowered to the plug bottom surface.

* * * * *